US005886956A

United States Patent [19]

Fiedler

[11] Patent Number: 5,886,956

[45] Date of Patent: Mar. 23, 1999

[54] DISPLAY FOR ILLUSION OF FLOATING IN THE AIR

[75] Inventor: Lubor Fiedler, Spittal/Drau, Austria

[73] Assignee: Tenyo Co., Ltd., Tokyo, Japan

[21] Appl. No.: 69,967

[22] Filed: Apr. 30, 1998

[30] Foreign Application Priority Data

May 6, 1997 [JP] Japan ..... 9-115659

[51] Int. Cl.[6] ..... G04F 5/00

[52] U.S. Cl. ..... 368/165; 368/179; 368/137; 368/223

[58] Field of Search ..... 368/134–138, 368/165–166

[56] References Cited

U.S. PATENT DOCUMENTS

| | | | |
|---|---|---|---|
| 804,859 | 11/1905 | Johnson | 368/137 |
| 824,537 | 6/1906 | Gary | 368/137 |
| 2,936,174 | 5/1960 | Bathke . | |
| 2,976,039 | 3/1961 | Chouinard . | |
| 4,613,236 | 9/1986 | Nakamura | 368/165 |
| 5,159,583 | 10/1992 | Lee | 368/223 |

FOREIGN PATENT DOCUMENTS 918612 2/1963 United Kingdom .

*Primary Examiner*—Bernard Roskoski
*Attorney, Agent, or Firm*—Sixbey, Friedman, Leedom & Ferguson, P.C.; Gerald J. Ferguson, Jr.

[57] ABSTRACT

When front and rear pendulum arms are swung together under the action of a clock movement, the front pendulum arm can swing behind an article supported on a pin because a slit formed in the front pendulum arm allows the front pendulum arm to pass by the article supporting pin. The slit in the front pendulum arm is camouflaged not to exist by camouflaging patterns.

Therefore, although the article is supported on the pin with a space from the back board, the front pendulum arm can swing behind the article. The slit is camouflaged not to exist, so that the article will seem as if it supported itself or were floating in the air.

Since the front pendulum arm can swing behind the article, the illusion of the floating article in the air is further enhanced.

6 Claims, 4 Drawing Sheets

DISPLAY FOR ILLUSION OF FLOATING IN THE AIR

BACKGROUND OF THE INVENTION a. Field of the Invention

The present invention relates to a display adapted to create an illusion that a thing actually fixed on a support supports itself or is floating in the air, and more particularly to a display using a pendulum for emphasis of the illusion of a self-supporting or floating thing in the air.

b. Description of the Prior Art

A display of this kind is known from the disclosure in the U.S. Pat. No. 4, 967,953, for example, wherein it comprises a hollow regular-hexahedral case having an opening formed in the front thereof, a mirror plate fixed on the diagonal inside the case vis-à-vis to the front opening in the case, and a decoration fixed on the mirror surface of the mirror plate. In this display, the mirror plate on the diagonal of the case is camouflaged to create an illusion that the mirror plate does not exist and the decoration is floating in the space in the case.

SUMMARY OF THE INVENTION

The present invention has an object to provides a display using a pendulum to effectively enhance the illusion that a thing actually fixed on a support is floating in the air.

The above object can be accomplished by providing a display comprising a case, a back board and a pendulum drive, both fixed to the case, a article supported on a pin with a space from the front surface of the back board, a front pendulum arm disposed between the front side of the back board and the rear side of the article, and a rear pendulum arm disposed behind the back board, the front and rear pendulum arms being connected to each other and to a pendulum arm of the pendulum drive, thus the front and rear pendulum arms being swingable together under the action of the pendulum drive. The swing angle of the pendulum arms is set larger than the width of the article. The front pendulum arm has formed therein a slit to allow the front pendulum arm to pass by the article supporting pin, and camouflaging patterns are provided on the surfaces of the back board and front pendulum arms, respectively, to effectively make the existence of the slit unnoticeable.

The article is supported on the pin with a space from the back board, but when the front pendulum arm with the slit camouflaged not to exist swings behind the article, the latter will seem not supported by anything but as if it supported itself or were floating in the space in the case. Since the front pendulum arm is adapted to swing behind the article, the illusion that the article is floating in the air can be further enhanced.

As in the above, the front and rear pendulum arms are adapted to be swung by the drive, but they may also be adapted to be swingable by hand, which can provide a similar effect of illusion.

BRIEF DESCRIPTION OF THE DRAWINGS

These objects and other objects, features, aspects and advantages of the present invention will become more apparent from the following detailed description of the present invention when taken in conjunction with the accompanying drawings, in which.

DETAILED DESCRIPTION OF THE PREFERRED EMBODIMENTS

Figure 1:
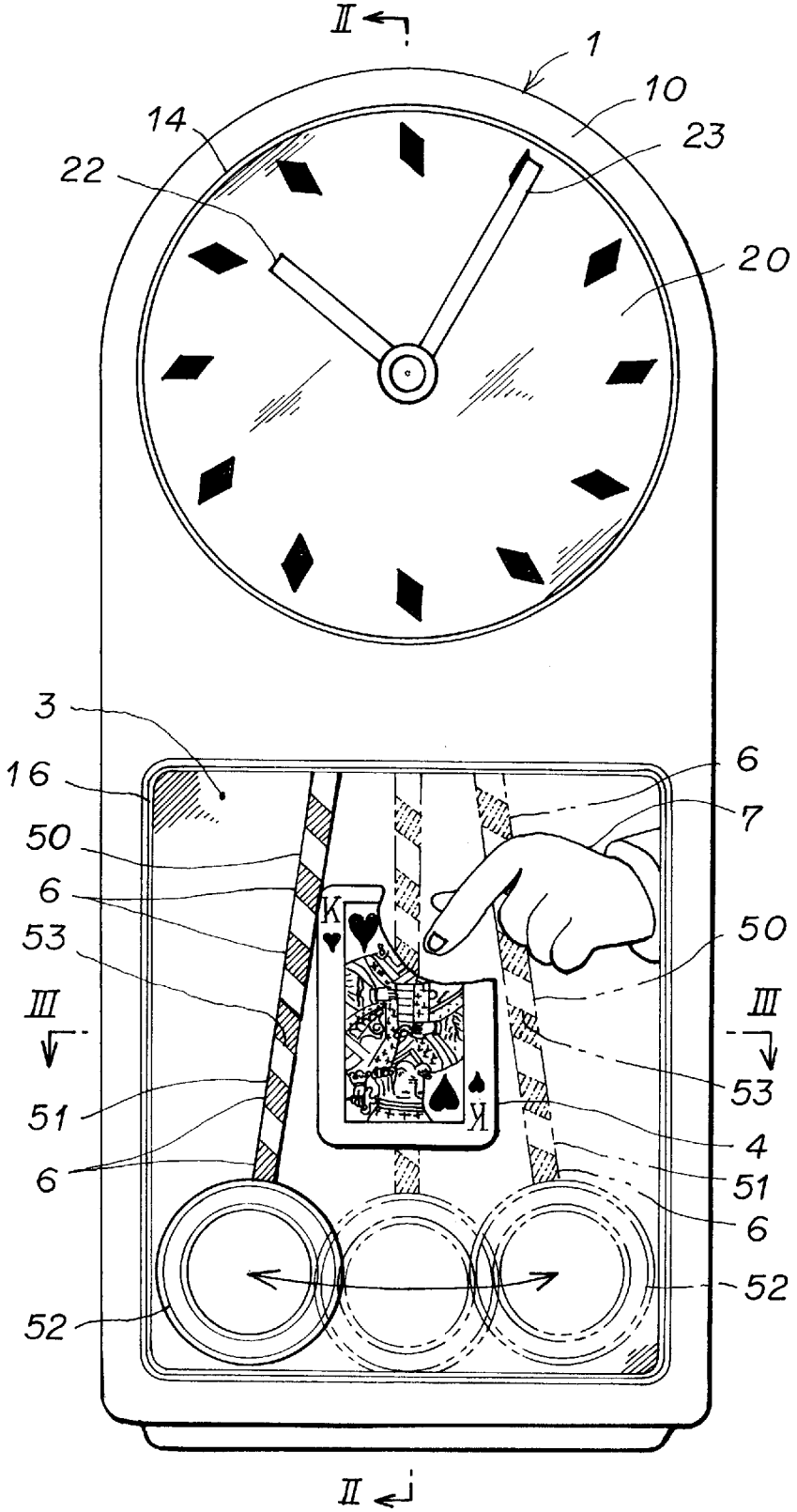
FIG. 1 is a front view of one embodiment of the display according to the present invention.

FIGS. 1 to 4 show one embodiment of the display according to the present invention, which is applied to a pendulum clock.

In Figures, a case is generally indicated with a reference 1. As seen from FIG. 2, the case 1 is an assembly of a front case 10 open at the rear thereof, and a rear case 11 open at the front thereof. Both the front and rear subassembly cases 10 and 11 are made of an opaque synthetic resin. They are joined to each other by a well-known method such as fitting, bonding, heat welding, ultrasonic welding or the like.

The case 1 is indented at 12 at the front of an upper half thereof. The indentation 12 is open at the front thereof, shallow and circular. A clock dial 20 is fixed on the inner wall or bottom 13 of the indentation 12. Also a clear cover 14 is fixed in the front opening of the indentation 12 by a well-known method such as fitting, bonding, heat welding, ultrasonic welding or the like. The clear cover 14 is a short hollow cylinder open at the rear thereof.

The case 1 has also a compartment 15 formed in the lower half thereof and having a rectangular shape. A clear rectangular cover 16 is fixed in the front opening of the compartment 15 by a well-known method such as fitting, bonding, heat welding, ultrasonic welding or the like.

It should be noted that the wording "half" used herein is approximate.

The case 1 is also open at 17 at the rear of the upper half thereof and opposite to the bottom 13 of the indentation 12 of the case 1. A cover 18 is provided in the opening 17. It has an elastic engagement pawl 19 which allows the cover 18 to be attached to or detached from the opening 17.

Figure 2:
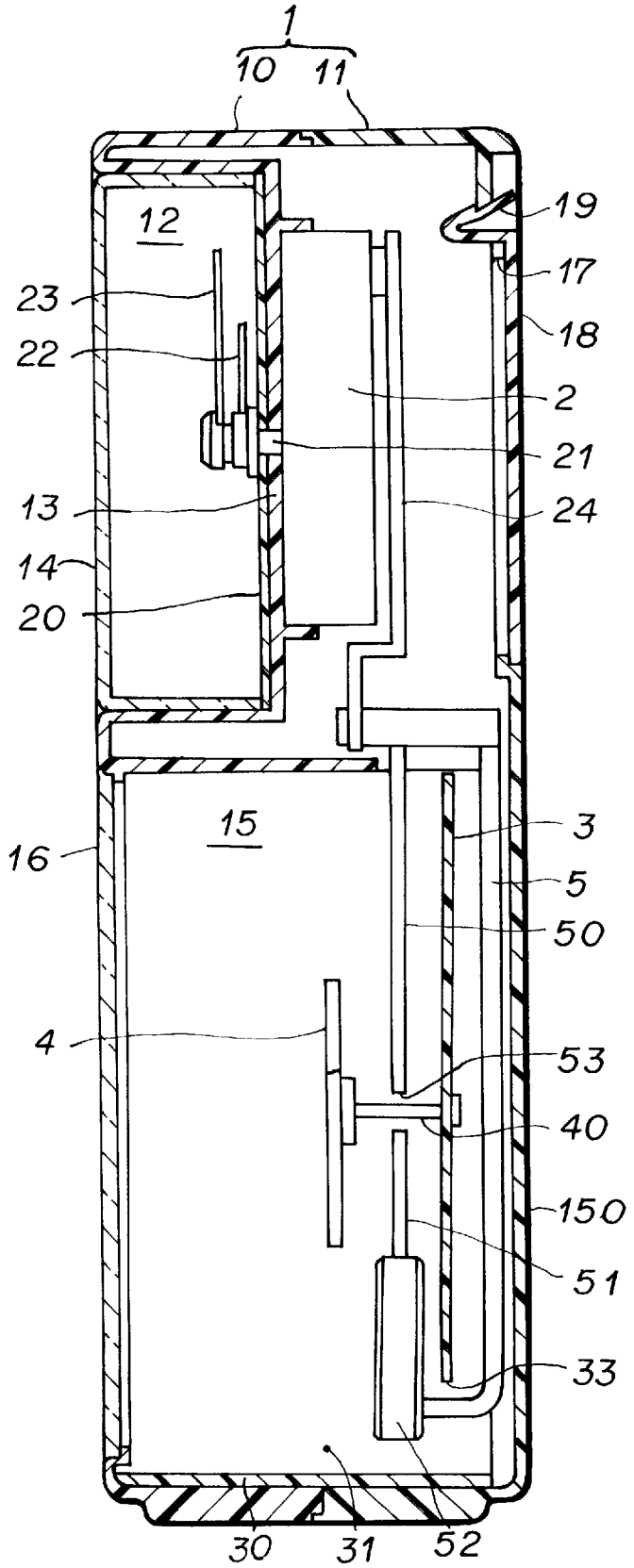
FIG. 2 is a sectional view taken along the line II—II in FIG. 1.

In FIG. 2, a clock movement 2 is provided to serve as a pendulum drive. As shown, it is fixed with screws (not illustrated) to the rear side of the bottom 12 of the indentation 12 of the case 1. The clock movement 2 has a stem 21 penetrated through the centers of the bottom 13 and clock dial 20. The stem 21 has fitted thereon an hour hand 22 and a minute hand 23. Namely the hour and minute hands 22 and 23 are disposed over the clock dial 20.

Also as shown in FIG. 2, a rectangular back board 3 is provided. As seen from FIGS. 2 and 3, the back board 3 has rectangular left and right side panels 31 and 32 fixed to the left and right lateral sides, respectively, thereof. Further, the left and right side panels 31 and 32 have a bottom panel 30 fixed to the lower ends thereof. There remains a space 33 between the top of the bottom panel 30 and the lower side of the back board 3. The back board 3, bottom panel 30, left and right side panels 31 and 32 are formed integrally from an opaque synthetic resin, for example. They are fixed inside the lower half of the case 1 by a well-known method such as fitting, bonding, heat welding, ultrasonic welding or the like. Therefore, the back board 3 will be fixed near the inner or front wall 150 of the lower half of the case 1 (or the compartment 15).

As in Figures, an article 4 is provided. In the embodiment shown in FIGS. 1 to 3, it is a card having a part (upper right) torn away. The card is the king of hearts in this embodiment. The article 4 is supported on a pin 40 nearly in the center of the back board 3 and with a space from the surface of the back board 3.

Also in Figures, a rear pendulum arm 5 is provided. It is made of a synthetic resin. As seen from FIGS. 2 and 3, this rear pendulum arm 5 is disposed behind the back board 3 and extends along and off the upper and the rear surface and lower sides of the back board 3. The rear pendulum arm 5 is connected at the upper end thereof to the lower end of a pendulum arm 24 of the clock movement 2. Thus, it can be driven to swing by the clock movement 2.

Figure 3:
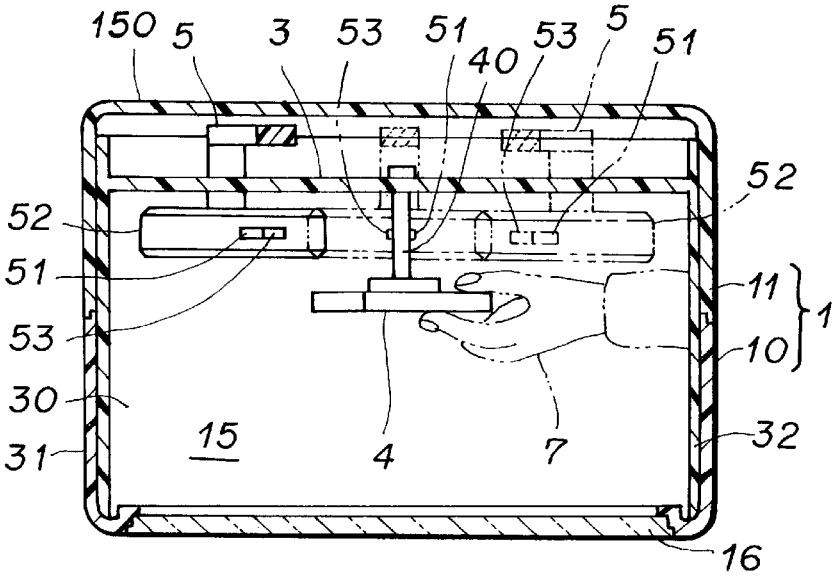
FIG. 3 is a sectional view taken along the line III—III in FIG. 1.

As in Figures, there are provided an upper front pendulum arm 50 and lower front pendulum arm 51, both made of a synthetic resin. They form together a front pendulum arm. As shown in FIGS. 1 to 3, the front pendulum arms, upper and lower, 50 and 51 are disposed between the front side of the back board 3 and the rear side of the article 4. The lower front pendulum arm 51 has a pendulum clock bob model 52 formed integrally at the lower end thereof.

The upper front pendulum arm 50 is fixed at the upper end thereof to the upper end of the rear pendulum arm 5. On the other hand, the lower front pendulum arm 51 is fixed at the lower end thereof to the lower end of the rear pendulum arm 5. Thus, a slit 53 will be formed between the lower end of the upper front pendulum arm 50 and the upper end of the lower front pendulum arm 51. Owing to this slit 53, the front pendulum arm is not blocked by the article supporting pin 40 but allowed to pass by the pin 40 along the slit 53 when it is swung. As seen from the above description, it will be appreciated that the rear pendulum arm 5, upper and lower front pendulum arms 50 and 51 form together a single structure and can be swung together. The swing angle of these pendulum arms 5, 50 and 51 is set larger than the width of the article 4.

The back board 3 has provided on the front surface thereof a camouflaging pattern (not illustrated) which will effectively make the existence of the slit 53 unnoticeable. In this embodiment, the camouflaging pattern is in black.

Similarly the upper and lower front pendulum arms 50 and 51 have provided on the surfaces thereof a camouflaging pattern 6 to effectively make the existence of the slit 53 unnoticeable. In this embodiment, the camouflaging pattern 6 is black stripes (shown with bold solid lines and dash lines in FIGS. 1 and 4). Each of the black stripes is nearly as wide as the slit 53.

In Figures, a hand model 7 is also provided to divert a watcher's attention from the slit 53 between the upper and lower front pendulum arms 50 and 51. The hand model 7 has a figure in which fingers are catching the torn-away portion of the card 4. The hand model 7 is fixed inside the compartment 15.

Figure 4:
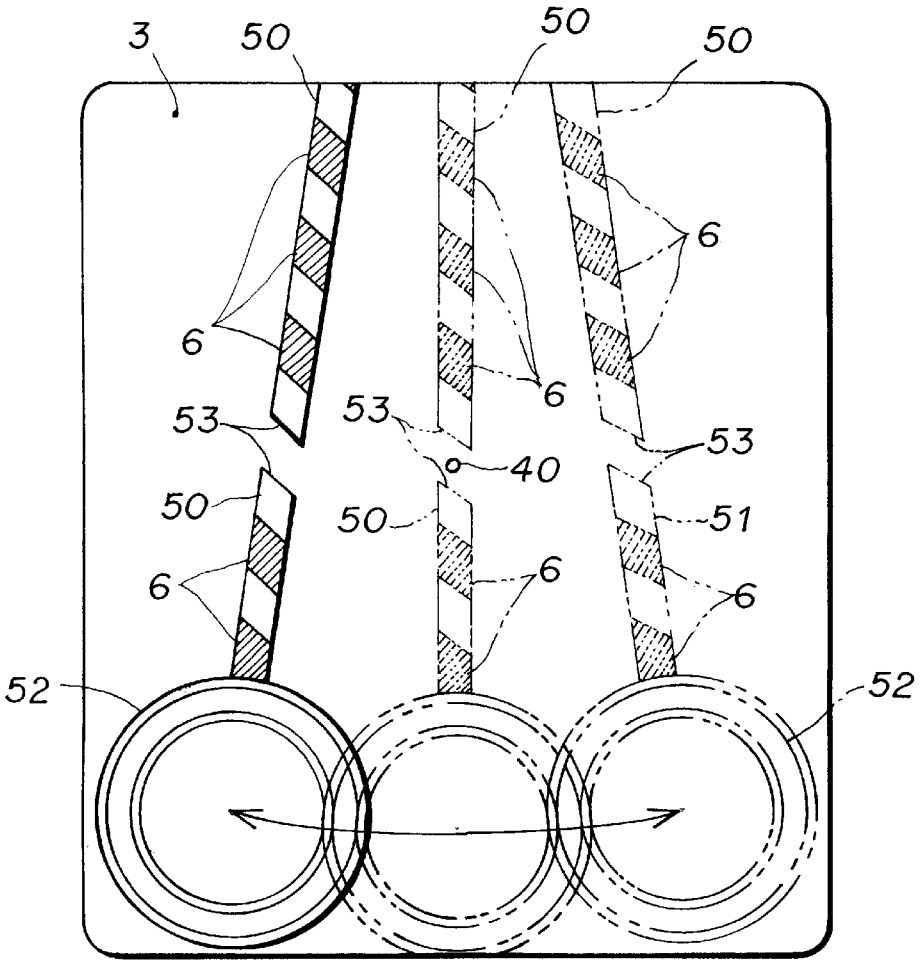
FIG. 4 is an explanatory drawing of the display in FIG. 1 with the article omitted, showing how the front pendulum arm is allowed to pass by the article supporting pin along the slit.

The embodiment of the display according to the present invention has the construction having been described in the foregoing. An example of its use will be explained herebelow:

First, the upper and lower front pendulum arms 50 and 51, and the rear pendulum arm 5, are driven by the clock movement 2 to swing as shown with the solid and dash lines in FIGS. 1, 3 and 4. When the arms 5, 50 and 51 swing, the slit 53 allows the front pendulum arm (50 and 51) to pass by the article supporting pin 40 which supports the article or card 4. Namely, the upper and lower front arms 50 and 51 seem as if they were a single pendulum and swung freely behind the card 4. The slit 53 is camouflaged not to exist by the camouflaging pattern stripes 6 provided on the upper and lower front pendulum arms 50 and 51 and that on the back board 3.

The slit 53 is camouflaged as will be seen from FIG. 4. Namely, the slit 53 has a size equivalent to that of each camouflaging stripe 6, and thus as the pendulum arms 50 and 51 swing, the background, that is to say, the black surface, of the back board 3 will be seen through the slit 53, which will provide an illusion that the pendulum arms 50 and 51 are contiguous to each other.

The card 4 is supported by the pin 40 with a space from the back board 3. However, the slit 53 is camouflaged not to exist as mentioned above so that even when the pendulum arms 50 and 51 come out from behind the card 4, they will seem as if they were a single thing. Further, when the pendulum arms 50 and 51 swing behind the card 4, an enhanced illusion will be given that the card 4 is not supported but supports itself or is floating in the air.

More specifically, this embodiment of the display according to the present invention uses the hand model 7 fixed inside the compartment 15 and which seems to catch the torn-away portion of the card 4 with the fingers. This hand model 7 will further enhance the illusion that the card 4 is isolated from the back board 3 and thus floating in the air, and also it will effectively attract the watcher's attention toward the hand model 7 and card 4 and divert the attention away from the slit 53 between the upper and lower front pendulum arms 50 and 51.

In this embodiment, the clear cover 16 may be eliminated from the front of the compartment 15. In this case, the card 4 and upper and lower front pendulum arms 50 and 51 inside the opening 15 can be seen directly, not through the clear cover 16, so that the watcher will not have a doubt that the card 4 is fixed and supported on a transparent sheet, mirror or the like.

Figure 5:
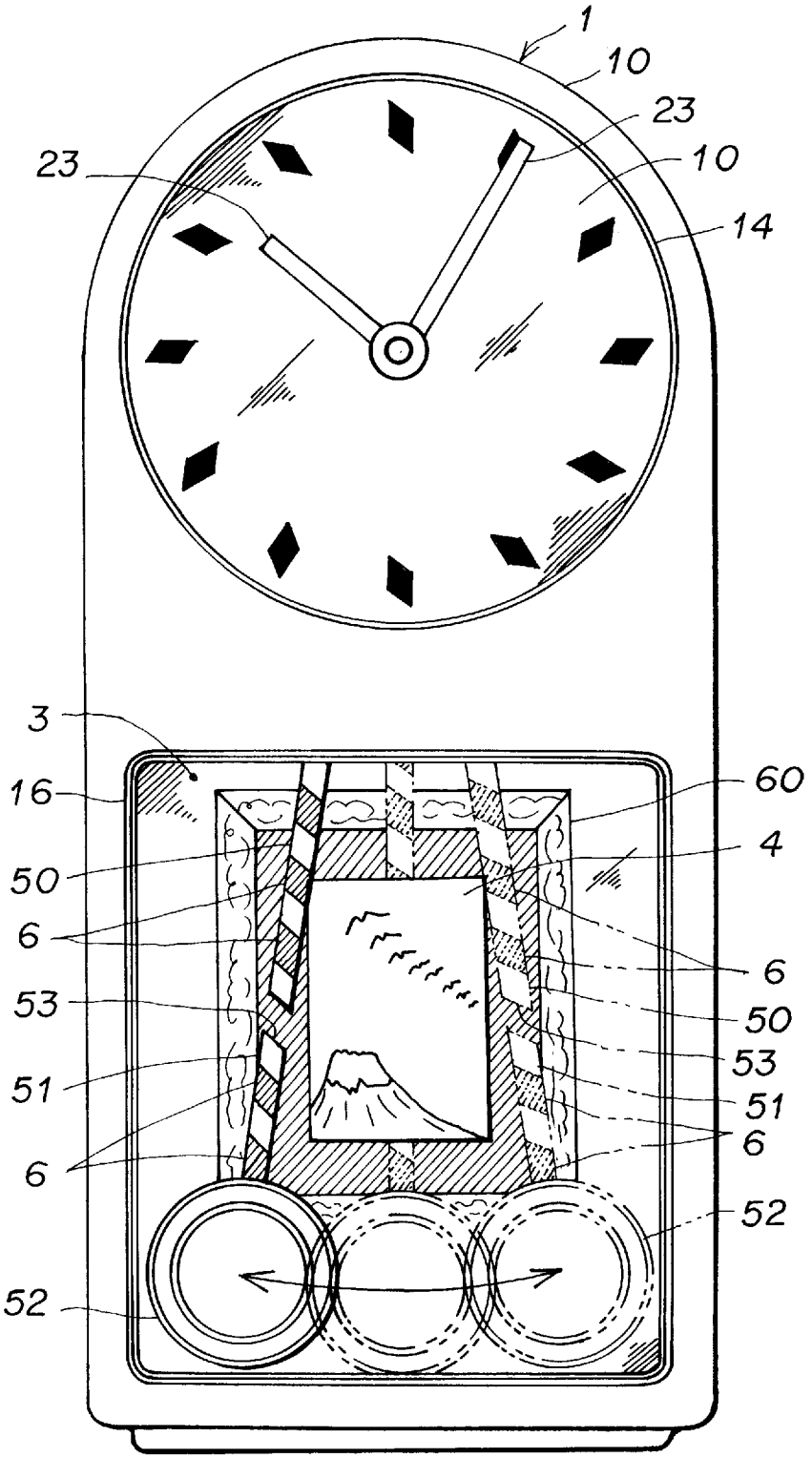
FIG. 5 is a front view of variants of the article and camouflage patterns of the display according to the present invention.

FIG. 5 is a front view of the display according to the present invention using a variant of the article and those of camouflaging patterns of the display of the present invention.

In FIG. 5, the variant of the article 4 is indicated with a reference 41. It is a small rectangular sheet on which a famous or popular picture is printed or otherwise provided. Like the card 4 in the aforementioned embodiment, the article 41 is supported on a pin (not illustrated) on the back board 3 with a space or clearance from the back board 3.

A camouflaging pattern 60 is provided on the back board 3 in this embodiment, and it comprises a black background pattern and a picture-frame pattern disposed around the back background. The horizontal width of the black background pattern is larger than the swing angle of the pendulum arms 50 and 51 along the slit 53.

It should be noted that the article 4 may be any other suitable one than those having been described above, for example, it may be a hook, key, doll or the like. Further, the camouflaging pattern may be any other suitable one than the aforementioned black background patter, picture-frame pattern 60 and stripe pattern 6.

Moreover, to divert the watcher's attention from the slit 53, a dish or ash tray may be provided on the bottom of the opening 15 (bottom panel 30) similarly to the hand model 7 in the aforementioned embodiments. It will further improve the effect of illusion of the display.

In the aforementioned embodiments, the case 1 and back board 3 may be formed integrally, and also the pendulum arm 24 of the clock movement 2 and the front and rear pendulum arms 5, 50 and 51 may be formed integrally.

The aforementioned embodiments are applied to a pendulum clock, but it should be noted that the display according to the present invention is applicable to any other things. The present invention can be applied to a toy cradle, for example.

The display according to the present invention can be placed, for use, directly on a horizontal surface such as a table, counter or the like, or as hooked on a vertical surface such as a wall, pillar or the like.

Also, the front and rear pendulum arms can be swung by hand without using any pendulum drive such as the clock movement 2.

What is claimed is:

1. A display, comprising:

a case;

a back board and a pendulum drive, both fixed to the case;

an article supported on a pin on the back board with a space from the surface of the back board;

a rear pendulum arm disposed behind the back board and connected to a pendulum arm of the pendulum drive to be swingable;

a front pendulum arm disposed between the front side of the back board and the rear side of the article, having formed therein a slit to allow the front pendulum to pass by the article supporting pin, and formed integrally with the rear pendulum arm to be swingable through an angle larger than the width of the article; and camouflaging patterns provided on the surfaces of the back board and front pendulum arm to make the existence of the slit unnoticeable.

2. A display, comprising:

a case having a clock dial disposed on the upper front side thereof and a lower compartment open at the front thereof;

a clock movement fixed in the upper portion of the case to be a pendulum drive;

an hour hand and a minute hand fitted on a stem of the clock movement and disposed over the clock dial;

a back board fixed near the bottom of the compartment of the case;

an article supported on a pin on the back board with a space from the surface of the back board;

a rear pendulum arm disposed behind the back board and connected to a pendulum arm of the clock movement to be swingable;

a front pendulum arm disposed between the front side of the back board and the rear side of the article, having formed therein a slit to allow the front pendulum to pass by the article supporting pin, and formed integrally with the rear pendulum arm to be swingable through an angle larger than the width of the article;

a pendulum clock bob model provided at the lower end of the front pendulum arm; and camouflaging patterns provided on the surfaces of the back board and front pendulum arm to make the existence of the slit unnoticeable.

3. The display as set forth in claim 2, wherein the camouflaging patterns are a black background pattern provided on the surface of the back board and a stripe pattern provided on the front pendulum arm, and each stripe is nearly as wide as the slit.

4. The display as set forth in claim 2, wherein the article is a card partially torn away, a hand model is fixed inside the opening to divert the watcher's attention from the slit in the front pendulum arm, and the hand model is formed to catch, with fingers, the partially torn-away portion of the card.

5. The display as set forth in claim 2, wherein the article is a sheet on which a famous or popular picture is printed or otherwise provided, and the camouflaging patterns are a black background pattern and a picture-frame pattern disposed around the black background pattern.

6. A display, comprising:

a case;

a back board fixed to the case;

an article supported on a pin on the back board with a space from the surface of the back board;

a rear pendulum arm disposed behind the back board and installed to the case to be swingable;

a front pendulum arm disposed between the front side of the back board and the rear side of the article, having formed therein a slit to allow the front pendulum arm to pass by the article support pin, and formed integrally with the rear pendulum arm to be swingable together with the rear pendulum arm; and camouflaging patterns provided on the surfaces of the back board and front pendulum arm to make the existence of the slit unnoticeable.

* * * * *